US006004448A

United States Patent [19]

Martyak

[11] Patent Number: 6,004,448

[45] Date of Patent: Dec. 21, 1999

[54] DEPOSITION OF CHROMIUM OXIDES FROM A TRIVALENT CHROMIUM SOLUTION CONTAINING A COMPLEXING AGENT FOR A BUFFER

[75] Inventor: Nicholas M. Martyak, Doylestown, Pa.

[73] Assignee: Atotech USA, Inc., N.J.

[21] Appl. No.: 08/487,437

[22] Filed: Jun. 7, 1995

Related U.S. Application Data

[63] Continuation-in-part of application No. 08/469,020, Jun. 6, 1995, abandoned.

[51] Int. Cl.[6] ..... C25D 5/12

[52] U.S. Cl. ..... 205/178; 205/319

[58] Field of Search ..... 205/319, 199, 205/178

[56] References Cited

U.S. PATENT DOCUMENTS

| | | | |
|---|---|---|---|
| 3,706,641 | 12/1972 | Huba et al. | 204/51 |
| 3,833,485 | 9/1974 | Crowther et al. | 204/51 |
| 3,954,574 | 5/1976 | Gyllenspetz et al. | 204/51 |
| 4,053,374 | 10/1977 | Crowther | 204/51 |
| 4,054,949 | 10/1977 | Gyllenspetz et al. | 204/51 |
| 4,137,132 | 1/1979 | Ward et al. | 204/38 R |
| 4,167,460 | 9/1979 | Tomaszewski | 204/51 |
| 4,169,022 | 9/1979 | Ward et al. | 205/319 |
| 4,450,052 | 5/1984 | McMullen et al. | 204/51 |
| 4,460,438 | 7/1984 | Tardy et al. | 204/51 |
| 4,461,680 | 7/1984 | Lashmore | 204/41 |
| 4,520,077 | 5/1985 | Lavezzari | 204/41 |
| 4,612,091 | 9/1986 | Benaben et al. | 204/51 |
| 4,617,095 | 10/1986 | Tomaszewski | 204/41 |
| 4,804,446 | 2/1989 | Lashmore et al. | 204/51 |
| 4,877,496 | 10/1989 | Yaganawa et al. | 205/246 |
| 5,294,326 | 3/1994 | Shahin | 205/287 |

*Primary Examiner*—Kishor Mayekar
*Attorney, Agent, or Firm*—Finnegan, Henderson, Farabow, Garrett & Dunner, L.L.P.

[57] ABSTRACT

A water-soluble composition of matter free of an added buffering agent, for electrolytically depositing a chromium oxide coating on a metal substrate is disclosed comprising a mixture of a complexing agent for a buffering agent such as a boron oxide complexing agent that might be introduced into the composition, a trivalent chromium compound, a weak chelating agent, an optional conductivity enhancing cation, an optional depolarizer, and an optional surfactant. A process is also described as well as a product obtained by the process.

15 Claims, 1 Drawing Sheet

DEPOSITION OF CHROMIUM OXIDES FROM A TRIVALENT CHROMIUM SOLUTION CONTAINING A COMPLEXING AGENT FOR A BUFFER

RELATED APPLICATIONS

This application is a continuation in part application of U.S. patent application Ser. No. 08/469,020 filed Jun. 6, 1995, now abandoned and which is incorporated herein by reference.

BACKGROUND OF THE INVENTION

1. Field of the Invention

The field of the invention comprises a soluble composition of matter and process for electrolytically depositing a chromium oxide coating on a metal substrate from a bath containing a trivalent chromium compound.

2. Description of the Related Art

The majority of tin mills produce Electrolytic Chromium Coated Steel (ECCS) from chromium plating baths based on hexavalent chromium. Although the chromium layer provides protection for the steel or tin layer or zinc layer on the steel, the surface of the chromium is not especially suitable for applying other coatings since it is difficult to get other materials to adhere to it. Accordingly, the chromium metal is converted into a chromium oxide to promote adhesion. Strong oxidizing solutions such as hexavalent chromium solutions make a thin oxide on chromium automatically. A second step may be used for better control.

One of the difficulties with employing hexavalent chromium compounds in electrolytic coating baths for this process is that it is considered carcinogenic, teratogenic and toxic. As a result, use of these baths present occupational and environmental problems. Employing safe equipment such as ventilating and recovery systems to prevent atmospheric and water pollution as well as safe operating procedures that require highly trained and skilled operators minimize or avoid these problems.

Trivalent chromium compounds substantially eliminate or minimize occupational and environmental problems associated with hexavalent chromium. Trivalent chromium solutions, however, do not form oxide while plating the metal using prior art processes.

The prior art in one instance, teaches that the electrolytic deposition of chrome oxides from trivalent chromium baths proceeds in two steps, the first of which involves electrolytic deposition of chromium metal from a trivalent chromium bath, the second, a conversion of the chromium metal coating to a chromium oxide compound.

Specifically in this regard, Lavezzari, U.S. Pat. No. 4,520,077 describes both a two-step and a so-called "one-step" process for depositing chromium metal and chromium oxide from a trivalent chromium bath. The reaction deposits chromium metal and afterwards trivalent chromium in the bath also reacts to form a chromium hydroxide on the deposited chromium metal. A subsequent dehydration or oxidation process converts the chromium hydroxide to a chromium oxide. The patentee specifies that the electrolytically deposited trivalent chromium film transforms chemically into chromium hydroxide by an optimal combination of at least the electrolytic bath composition, temperature, types of anodes, and cathodic current density.

The one-step process of Lavezzari is directed to the formation of a two layer coating of chromium metal with a chromium hydroxide top coat in a single bath. The two-stage process deposits a chromium metal first coat in one bath and a chromium hydroxide coating in a second bath utilizing the same chemistry. In both the one-stage and two-stage processes, a boron oxide such as boric acid is added to the coating bath.

Shahin, U.S. Pat. No. 5,294,326 describes a composition for applying chromium metal from a trivalent chromium electrolytic coating bath which requires boric acid anywhere from about 50 grams per liter of the bath up to its solubility limit in the bath.

McMullen et al., U.S. Pat. No. 4,450,052 also describe conventional trivalent chromium plating baths for the deposition of chromium metal which also contain boric acid. Lashmore et al., U.S. Pat. No. 4,804,446; Lashmore, U.S. Pat. No. 4,461,680 and Huba et al., U.S. Pat. No. 3,706,641 all describe electrodeposition of chromium metal from a trivalent chromium metal electrolyte which also employ boric acid as a component in the bath.

Benaben et al., U.S. Pat. No. 4,612,091 describe a chromium electroplating bath based on trivalent chromium which is not chelated whereas, Tardy et al., U.S. Pat. No. 4,460,438 describe a composition and a process for the electrolytic deposit of chromium from a trivalent chromium bath obtained by the reduction of chromic acid in a sulfuric medium by means of an excess of a reducing alcohol such as methanol.

The high speed electrolytic coating of steel, or other metals used on an industrial scale, requires high current densities. Industry presently uses current densities somewhere in the range of about 800 amps per square foot (ASF) and seeks the advantage of a composition and a process for forming chromium oxide coatings on steel or other metals at this or higher current densities. Higher current densities would increase production rates or line speeds if bath compositions were available that would allow plating at these conditions.

Industry also seeks the advantage of directly obtaining chromium oxide coatings from trivalent chromium compositions which have high surface area and may chemically bond to the coating so that other coatings such as organic coatings e.g., epoxy coatings, phenolic coatings and buff-vinyl coatings would adequately adhere to the chromium oxide substrate.

Manufacturers also want to obtain the advantage of a composition and a method for electrolytically depositing chromium coatings from trivalent chromium compositions at plating efficiencies of from about 30 to about 40 percent or greater, and at current densities from about 500 to about 1000 ASF.

The coating industry also wants the advantage of a composition and a process for depositing chromium oxide coatings in an amount up to or greater than about 2 $mg/ft^2$ and especially coating weights greater than about 0.4 $mg/ft^2$ that will provide excellent adhesion of coatings such as organic coatings e.g., epoxy coatings, phenolic coatings and buff-vinyl coatings and other coatings known in the art.

Jones and Shahin in application Ser. No. 08/469,020 filed Jun. 6, 1995, now abandoned, describe a process for obtaining chromium oxide coatings from a trivalent chromium compound. It was discovered in this process that boric acid and similar boron oxide compounds act as buffering agents to stabilize the pH of the chrome plating bath composition during the electroplating operation. Stabilizing the pH of the bath at somewhere around 2.5 promotes the deposition of chrome metal in the electrolytic coating process. The buffering agents substantially minimize or eliminate any increases in pH that occur in the cathode film of the cell. Jones and Shahin, however, eliminated added buffers or boron oxide compounds from the trivalent chromium oxide composition in order to make the pH increase faster in the cathode film. This faster increase in pH allows for the direct formation of chrome oxides on the cathode. It was found that the trivalent chromium at higher pH's formed oligomers unlike hexavalent chromium compounds, and readily plated on most metallic surfaces directly to form a chromium oxide during the plating process.

Electrolytic chromium coated steel (ECCS) sometimes referred to as tin free steel or TFS, as described by Shahin in U.S. Pat. No. 5,294,326 applied from trivalent chromium baths avoid the problems associated with hexavalent chromium. The trivalent chromium baths, however, contain boric acid or boron oxide compounds or other similar buffering agents.

Employing a chromium metal-chromium oxide two bath high speed production line, in which the first bath contains TFS trivalent chromium and a boron oxide buffering agent as described by Shahin, and the second trivalent chromium free of boron oxide buffers to promote chromium oxide production, as described by Shahin and Jones, encounters a problem because of the high line speeds employed in the TFS manufacturing process. There is considerable drag-out from the vessel containing the first plating bath into the vessel containing second plating bath used to deposit an oxide film. Running the production line for some time, drags or introduces boric acid or other boron oxide compounds or buffering agents into the second plating vessel which must be free of these compounds in order to deposit a chrome oxide film. As a result chromium deposition on the substrate increases and protective chromium oxide film production decreases or is substantially terminated.

It would be an advantage, therefore, to provide a process and a composition that eliminates or minimizes the buildup of boric acid, other boron oxide compounds or other buffering agents in the second plating vessel as a result of this drag-out.

These and other advantages are obtained according to the present invention which comprises a composition, process and product obtained by the process which substantially obviates one or more of the limitations and disadvantages of the described prior compositions, processes and products.

The present invention comprises a water soluble composition and a process for electrolytically depositing chromium oxide coatings directly from trivalent chromium as well as a product produced by the process in which the foregoing and other disadvantages are overcome.

Additional features and advantages of the invention will be set forth in the description which follows, and in part will be apparent from the description, or may be learned by practice of the invention. The objectives and other advantages of the invention will be realized and attained by the composition, process and product obtained by the process, particularly pointed out in the written description and claims hereof.

SUMMARY OF THE INVENTION

To achieve these and other advantages and in accordance with the purpose of the invention, as embodied and broadly described, the invention comprises a water-soluble composition of matter that is free of an added buffering agent for electrolytically depositing a chromium oxide coating on a metal substrate. The bath comprises a mixture of a complexing agent for any buffers introduced into the bath, a trivalent chromium compound, a weak chelating agent, an optional conductivity enhancing cation, an optional depolarizer, and an optional surfactant.

In one embodiment, the conductivity enhancing cation comprises an alkali metal cation, the depolarizer comprises a bromide salt, and the weak chelating agent comprises a formic acid anion.

In yet another embodiment of the invention, a water-soluble composition of matter that is free of an added buffering agent is provided for electrolytically depositing a chromium oxide coating on a metal substrate comprising:

- a complexing agent for any buffers introduced into the bath in an amount from 0.1 to about 5 mols;
- a trivalent chromium compound in an amount from about 0.03 to about 0.5 mols;
- a weak chelating agent in an amount from about 0.04 to about 0.7 mols;
- a conductivity enhancing cation in an amount from about 0.3 to about 5.0 mols;
- a depolarizer in an amount from about 0.01 to about 0.15 mols; and
- an optional surfactant.

The ratio of chromium to chelating agent ranges from about 0.3 to about 3.0 mole ratio.

The complexing agent for buffering agents such as boron oxides e.g. as boric acid include d- or l-mannitol, and racemic mixtures thereof, or the various gluconates known in the art and their equivalents which have been found will minimize or eliminate chromium deposition in the second plating vessel of the two-step process and increase the ability to form an oxide coating.

The conductivity enhancing cation may comprise a potassium cation, the depolarizer may comprise a compound having a bromide ion, and the weak chelating agent may comprise a formic acid anion. In one embodiment, the trivalent chromium compound comprises basic chromium (III) sulfate.

The invention also comprises a process of coating a metallic substrate employing the foregoing compositions, such as a substrate comprising a steel, chromium or tin substrate wherein the chromium oxide coated on these substrates is optionally coated with an organic coating such as an epoxy coating, a phenolic coating or a buff-vinyl coating. The invention also comprises a product obtained by this process.

The process of depositing a chromium oxide coating on a metal substrate comprises passing an electrically conductive substrate through a first trivalent chromium bath containing a buffering agent and electrolytically depositing chromium on the substrate to obtain a chromium coated substrate. Continuously passing the substrate through the bath is preferred.

This is followed by directly passing the chromium coated substrate into a second trivalent chromium bath composition free of an added buffering agent. Again, continuously passing the substrate through the second bath is preferred. The second trivalent chromium bath composition comprises a mixture of a complexing agent for the buffering agent, a trivalent chromium compound, a weak chelating agent, an optional conductivity enhancing cation, an optional depolarizer, and an optional surfactant, and electrolytically converting the composition to a chrome oxide coating on the surface of the chrome coated substrate.

BRIEF DESCRIPTION OF DRAWING

The drawing shows various linear sweep voltammogram (LSV) chromium baths.

DETAILED DESCRIPTION

Figure 1:
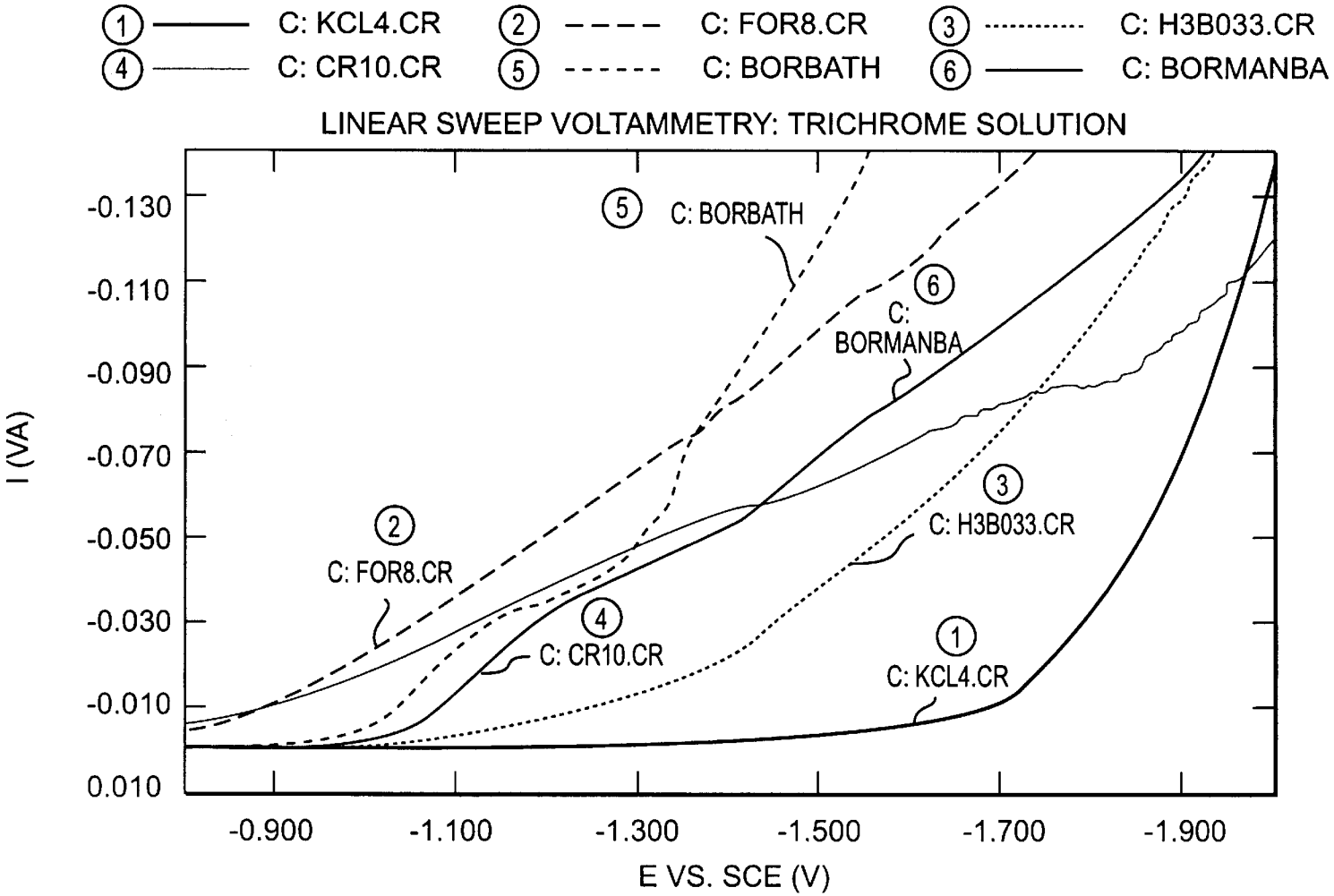

Tin Free Steel (TFS) also known as ECCS, and tin plated steel has a chromium oxide top layer to reduce corrosion and increase adhesion of paints, lacquers or organic coatings to the substrate. Chromium oxides form spontaneously or readily deposit from hexavalent chromic acid plating solutions; however, chromium oxides do not form when chromium is plated out of trivalent chromium baths which contain buffering agents such as boron oxides, described by Lavezzari as catalysts, in U.S. Pat. No. 4,520,077.

Jones and Shahin discovered, that boric acid and similar boron oxide compounds act as buffering agents to stabilize the pH of the composition during plating. The buffering agents help to stabilize the pH of the bath which is somewhere around 2.5 and promote the deposition of chrome metal in the electrolytic coating process. The buffering agents substantially minimize or eliminate any increases in pH that occur in the cathode film of the cell.

Jones and Shahin eliminated added buffers or boron oxide compounds from the trivalent chromium oxide composition in order to make the pH increase faster in the cathode film. This faster increase in pH allows for the direct formation of chrome oxides on the cathode. It was found that the trivalent chromium at higher pH's formed oligomers unlike hexavalent chromium compounds, and readily plate on most metallic surfaces directly to form a chromium oxide during the plating process.

One of the major drawbacks to the two-step process, in which chrome metal is applied to a steel substrate in a first vessel containing trivalent chrome and a boron oxide or boric acid buffer, and a second vessel for producing a chrome oxide coating from a trivalent chromium solution free of boron oxides, is the eventual buildup of boron oxides or boric acid in the second solution. Because of the high line speeds employed during the manufacture of TFS there is considerable drag-out of the plating solution from the first plating vessel into the second plating vessel, i.e., the vessel containing the solution used to deposit an oxide film. Eventually, there is a sufficient buildup of boron oxides or boric acid in the second solution which leads to more chromium deposition on the steel and less of the protective chromium oxide coating. Eventually, there will be sufficient buildup of boron oxides or boric acid in the second solution so that chromium oxides will not be deposited.

The present invention overcomes this by incorporating in the second solution, a component which reacts or complexes with boron oxides, boric acid or other buffers that may be present as a result of the drag-out of the first solution into the second solution. In one embodiment, it has been discovered that mannitol will sufficiently react with boric acid thereby decreasing the free boric acid in the second solution. Additionally, various gluconate salts can also be employed. Gluconates such as alkali metal salts and ammonium salts can be used as well as saccharates, glucoheptonates, glycerates, tartrates and the other art known hydroxy carboxylic acids and salts can also be employed in this regard.

The composition of the present invention allows electrolytic deposition of coatings of chrome oxides on chromium that has been deposited on a metal substrate such as a steel substrate where the chromium layer has been applied in the first step of a two-step process by means of a trivalent chromium bath or other chromium bath containing boron oxides such as boric acid or other buffering agents. These buffering agents are dragged out of the first bath into the second chrome oxide plating bath which must be maintained substantially free of boron oxides such as boric acid and other buffering agents. The complexing agent enables the second bath to be substantially free or free of these buffering agents.

As noted above, the metals also include metal coatings on a substrate. For example, the substrates can comprise a metal or an alloy as described above or a non-metal where either is coated with one or more of the foregoing metals. For example, a metallized ceramic or plastic or other non-metallic substrate that has an electrically conductive area can be coated according to the invention. The invention therefore comprises coating these substrates with the composition and by the process of the invention to obtain novel products as well.

One of the preferred trivalent chromium compounds for applying chromium oxide coatings comprises basic chromium (III) sulfate (chrome tan) which has the formula $CrOHSO_4 \cdot Na_2SO_4 \cdot xH_2O$ and contains 17.2 percent of chromium. Other trivalent chromium compounds employed according to the invention, and that are known in the art include those disclosed by Barclay et al., U.S. Pat. No. 4,062,737 such as chromium (III) thiocyanate complexes; Tardyet al., U.S. Pat. No. 4,612,091 who describe the use of trivalent chromium ions in a solution with a low pH; U.S. Pat. No. 3,954,574; U.S. Pat. No. 4,141,803; U.S. Pat. No. 4,167,460; the trivalent chromium chloride salts disclosed by Lashmore et al., U.S. Pat. No. 4,804,446; and the chromium complexes described by Benaben et al., U.S. Pat. No. 4,460,438. Other specific trivalent chromium salts employed comprise chromium (III) formate, chromium (III) acetate, chromium (III) bromide hexahydrate, chromium (III) chloride hexahydrate, chromium (III) iodate, hydrate, chromium (III) nitrate, chromium (III) oxalate, chromium (III) orthophosphate, chromium (III) sulfate, hexamine chromium (III) chloride, hexaurea chromium (III) fluosilicate, chromium (III) fluoride tetrahydrate, chromium (III) iodide nonahydride, chromium (III) nitrate hexammonate, chromium (III) potassium oxalate, and the various art known equivalents thereof as well as, combinations thereof, especially the two, three component or four component combinations.

The composition also includes an optional conductivity enhancing cation, especially an ammonium or alkali metal cation such as a sodium, potassium or lithium cation but especially a potassium cation.

Employing a depolarizer in the composition substantially reduces or substantially eliminates the tendency of trivalent chromium compounds to oxidize at the anode to hexavalent chromium, the depolarizer comprising a halogen depolarizer, and especially a compound containing a bromide ion as a depolarizer since it oxidizes more readily at the anode than the trivalent chromium ion because of its lower oxidizing potential. In theory, an iodide salt could also be used, although this would also result in liberation of iodine at the anode. Fluoride and chloride salts also oxidize at the anode and result in the evolution of halogen gases during the coating process.

Additionally, using the proper anodes minimizes the oxidation of trivalent chromium to hexavalent chromium, such as carbon anodes as described by Benaben et al. in the U.S. Pat. No. 4,612,091 or nickel-chromium, or platinum anodes as well as lead, graphite, platinized titanium and the like as described by Lashmore in U.S. Pat. No. 4,461,680.

The composition also includes a weak chelating agent such as a formic acid anion, typically a formate salt such as an alkali metal formate, e.g., potassium formate. Other usable chelating agents include either glycolic acid, ammonium formate, acetic acid, ferrous ammonium sulphate, propionic acid, polycarboxylic acids, especially the lower molecular weight dicarboxylic acids and the hydroxycarboxylic acids such as citric acid and the like and the various esters and salts of the foregoing acids including the low molecular weight alkyl alcohol esters, i.e., those having from 1 to about 4 carbon atoms and the various isomeric forms thereof and the alkali and ammonia and amine salts thereof, especially the lower molecular weight alkyl amine salts as that term is described herein. Various mixtures, especially the two component, three component, or four component mixtures of these compounds may also be employed.

The chelating agent may comprise any of the various classes of weak chelating agents and specific compounds disclosed in Kirk-Othmer, *Encyclopedia of Chemical Technology,* Third Edition, Volume 5, pages 339–368, incorporated herein by reference. Chelating agents that are preferred comprise the aminocarboxylic acids and the hydroxycarboxylic acids. Some specific aminocarboxylic acids included in this respect comprise hydroxyethylethylenediamine-triacetic acid, nitrilotriacetic acid, N-dihydroxy-ethylglycine, and ethylenebis(hydroxyphenylglycine). Tetra (lower alkyl) ammonium hydroxy compounds may also be employed where the lower alkyl group has from about 2 to about 6 carbon atoms such as tetrabutyl ammonium hydroxide. The chelating agents also include carboxylic acids that comprise tartaric acid, gluconic acid and 5-sulfosalicylic acid. The amino carboxylic acids used as chelating agents include lysine, alanine, valine, leucine, isoleucine, proline, phenylalanine, tryptophan, methionine, glycine, serine, threonine, cystenine, tyrosine, asparagine, glutamine, aspartic acid, glutamic acid, arginine, histidine and the like including the so-called rare amino acids, e.g., gamma-amino butyric acid, gamma-methyleneglutamic acid, 5-hydroxy lysine and the like. Salts and esters, as those terms are defined herein, of these acids may also be used. Mixtures of chelating agents may also be used, e.g., two or three or four component mixtures.

The composition may include an optional surfactant such as an ethoxylated diamine as described by Shahin, U.S. Pat. No. 5,294,326. Generally, the surfactants comprise the nonionic surfactants known in the art, and as described in Kirk-Othmer (supra), used in an amount up to about 300 ppm of the coating bath. The exact nature of the surfactant is not critical to the performance of the bath of the present invention, although better coating results are obtained when a small amount of surfactant is present.

The coating process can be carried out over a pH range of from about 1 to about 4 and especially from about 2.2 to about 2.8. The coating temperature will be anywhere from about 20 to about 90 degrees centigrade and especially from about 30 to about 70 degrees centigrade. The current density may be anywhere from about 50 ASF to about 1300 ASF and especially from 300 to about 1000 ASF. Current density depends upon line speed in production.

The following examples are illustrative.

Chrome Oxide Bath

The trivalent chromium oxide process replaces the hexavalent process for coating tin and is used for applying chromium oxides on trivalent chromium whether decorative or functional, as a passivation coating.

An electrochemical method produced an adherent chromium oxide deposit on chromium by cathodic treatment in a trivalent chromium solution in a cell having a carbon anode, employing the following composition:

| | |
|---|---|
| mannitol | 5 g/l |
| Basic chromium (III) sulfate | 120 g/l |
| Potassium chloride | 250 g/l |
| Potassium bromide | 15 g/l |
| Potassium formate | 51.2 g/l |
| Wetting agent | 100 ppm |

The pH of the coating bath was 2.5, a coating temperature of about 49° C., and a current density of 15 A/dm$^2$. The coating cell employed comprised a beaker containing 1.4 liters of solution and 3 graphite anodes with a 0.95 cm diameter rod substrate arranged to provide a coated length of 5 cm. The coating process proceeded while maintaining constant temperature with stirring of the solution to prevent temperature gradients. Between 50 to about 100 mg of oxide as chromium metal/m$^2$ deposits in 1 to 5 seconds on both steel and chromium metal.

The chromium oxide formation obtained by the present invention follows as a second step after depositing boric acid buffered trivalent chromium on a metal substrate and especially TFS or ECCS products. Boric acid introduced into the chrome oxide bath is effectively complexed by the mannitol.

Electrochemical studies confirmed the formation of complexes of boric acid and graphically represented in the FIGURE which comprises various LSV curves.

1. KC14.CR—linear sweep voltammogram (LSV) showing hydrogen commencing on the chromium electrode at—1.7 V p 2. FOR8.CR—(KCl+Formic Acid) LSV showing increase in cathodic current due to the reduction of formic acid 3. H3B033.CR—(KCl+$H_3BO_3$) LSV showing hydrogen evolution on chromium commencing at approximately—1.4 V 4. CR10.CR—(KCl+CrTan+Formic Acid)—LSV showing two small plateaus one at −1.25 V and the other at −1.65 V. The plateau at 1.65 V is due to chromium deposition (or chromium oxide) in that stopping the sweep before this voltage limit does not discolor the electrode.

5. BORBATH—(KCl+CrTan+Formic Acid+Boric Acid) this LSV corresponds most closely with the complete trivalent chromium solution. Bright chromium deposits are made with this solution. Two plateaus are again seen, the first at −1.10 V and the second at −1.30 V. This second plateau is associated with chromium deposition. Note how the presence of boric acid shifts this potential anodically from −1.65 V to −1.30 V.

6. BORMANBA—(KCl+CrTan+Formic Acid+Boric Acid+Mannitol) The addition of mannitol to the complete solution again shifts the chromium deposition peak but this time cathodically; from −1.30 V in the "normal" trivalent solution to about −1.55 V in the presence of mannitol. The chromium deposit has signs of an oxide film.

Chromium oxide coatings are obtained using the composition of the present invention with good results.

The chromium oxide coatings of the invention optionally have organic coatings applied to them such as epoxy coatings, phenolic coatings and buff-vinyl coatings, especially chromium oxide coatings applied to steel, chromium or tin. Organic coatings successfully applied to the chromium oxide coatings obtained according to the invention comprised commmercially available epoxy henolic, clear epoxy, and buff vinyl coaitngs. Baking the coatings after application completed the process.

A tape test on the epoxy coated panel showed that the coating had good adhesion to the oxide.

The tape test comprised scribing a one inch by four inch coupon having the coating applied to it, and immersing the scribred coupon in a 1.5 wt. % sodium chloride/1.5 wt. % citirc acid water solution for four days. After air drying the coupon at room temperature for several days, a clear transparent tape, 3M 610, is firmly applied to the scored surface and rapidly removed after which, the tape is placed on a white paper background. By observing any coating removed an operator rates the adhesion visually as acceptable or unacceptable.

It will be apparent to those skilled in the art that modifications and variations can be made in a novel composition of matter and process and product produced by the process as described herein without departing from the spirit or scope of the invention. It is intended that these modifications and variations and their equivalents are to be included as part of this invention, provided they come within the scope of the appended claims.

What is claimed is:

1. A water-soluble composition of matter free of an added buffering agent for electrolytically depositing a chromium oxide coating on a metal substrate comprising a complexing agent for complexing a chrome bath buffer, said complexing agent being present in an amount sufficient to increase the formation of a chromium oxide coating upon introduction of the complexing agent for a chrome bath buffer into said composition, said composition further comprising a trivalent chromium compound, a weak chelating agent, an optional conductivity enhancing cation, an optional depolarizer, and an optional surfactant.

2. A water-soluble composition of matter for electrolytically depositing a chromium oxide coating on a metal substrate comprising a complexing agent for a chrome bath buffer, said complexing agent being present in an amount sufficient to form a complex with any chrome bath buffer introduced into said composition of matter by dragout and thereby reduce chromium deposition and increase chromium oxide deposition on a substrate when electrolytically depositing a chromium oxide coating with said composition, said composition also comprising a trivalent chromium compound, a weak chelating agent, an optional conductivity enhancing cation, an optional depolarizer, and an optional surfactant.

3. The composition of claim 2 wherein:

said complexing agent comprises mannitol or a gluconate;

said conductivity enhancing cation comprises an alkali metal cation;

said depolarizer comprises a bromide salt and; said weak chelating agent comprises a formic acid anion.

4. The composition of claim 3 where said alkali metal cation comprises a potassium cation and said depolarizer comprises potassium bromide.

5. The composition of claim 4 wherein said trivalent chromium compound comprises basic chromium (III) sulfate.

6. The water-soluble composition of claim 5 comprising:

said complexing agent in an amount from about 0.1 to about 5 mols;

said trivalent chromium compound in an amount from about 0.03 to about 0.5 mols;

said conductivity enhancing cation in an amount from about 0.3 to about 5.0 mols;

said depolarizer in an amount from about 0.01 to about 0.15 mols; and said weak chelating agent in an amount from about 0.04 to about 0.7 mols.

7. A process of depositing a chromium oxide coating on a metal substrate comprising passing an electrically conductive substrate through a first trivalent chromium bath containing a buffering agent and electrolytically depositing chromium on said substrate to obtain a chromium coated substrate followed by directly passing said chromium coated substrate into a second trivalent chromium bath composition, said second trivalent chromium bath containing said first trivalent chromium bath buffering agent introduced into said second trivalent chromium bath as dragout, said second trivalent chromium bath composition comprising a complexing agent for said buffering agent, in an amount sufficient to increase the formation of a chromium oxide coating, by complexing any of said buffering agent introduced into said second bath by dragout to minimize or eliminate any chrome deposition in said second trivalent chromium bath, said second trivalent chromium bath also comprising a trivalent chromium compound, a weak chelating agent, an optional conductivity enhancing cation, an optional depolarizer, and an optional surfactant, and electrolytically forming a chromium oxide coating on said chromium coated substrate.

8. A process of depositing a chromium oxide coating on a metal substrate comprising passing an electrically conductive substrate through a first trivalent chromium bath containing a buffering agent and electrolytically depositing chromium on said substrate to obtain a chromium coated substrate followed by directly passing said chromium coated substrate into a second trivalent chromium bath composition, said second trivalent bath composition comprising a complexing agent for said buffering agent to complex said buffering agent introduced into said second trivalent chromium bath composition by dragout, said complexing agent being present in an amount sufficient to reduce chromium deposition and increase chromium oxide deposition in said second trivalent chromium bath, said composition also comprising a trivalent chromium compound, a weak chelating agent, an optional conductivity enhancing cation, an optional depolarizer, and an optional surfactant, and electrolytically forming a chromium oxide coating on said chromium coated substrate.

9. The process of claim 8 wherein:

said complexing agent comprises mannitol or a gluconate and said buffering agent comprises a boron oxide;

said conductivity enhancing cation comprises an alkali metal cation;

said depolarizer comprises a bromide salt and; said weak chelating agent comprises a formic acid anion.

10. The process of claim 9 where said alkali metal cation comprises a potassium cation and said depolarizer comprises potassium bromide.

11. The process of claim 10 wherein said trivalent chromium compound comprises basic chromium (III) sulfate.

12. The process as in claim 11 where said composition comprises:

said complexing agent for said buffering agent in an amount from about 0.1 to about 5 mols;

said trivalent chromium compound in an amount from about 0.03 to about 0.5 mols;

said conductivity enhancing cation in an amount from about 0.3 to about 5.0 mols;

said depolarizer in an amount from about 0.01 to about 0.15 mols; and said weak chelating agent in an amount from about 0.04 to about 0.7 mols.

13. The process of claim 12 wherein said substrate comprises iron, steel, chromium, nickel, tin, zinc, copper, aluminum, magnesium or titanium.

14. The process of claim 12 wherein said complexing agent comprises mannitol.

15. The process of claim 12 wherein said substrate comprises steel and said chromium oxide coating is coated with an organic coating wherein said organic coating is an epoxy coating, a phenolic coating or a buff-vinyl coating.

* * * * *

UNITED STATES PATENT AND TRADEMARK OFFICE

CERTIFICATE OF CORRECTION

PATENT NO.: 6,004,448

DATED: December 21, 1999

INVENTOR(S): Nicholas M. MARTYAK

It is certified that an error appears in the above-identified patent and that said Letters Patent is hereby corrected as shown below:

Claim 3, col. 9, line 42, change "claim 2" to --claim 1 or 2--.

Claim 9, col. 10, line 40, change "claim 8" to --claim 7 or 8--;

col . 10, line 45, delete "said weak" ; and col. 10, line 46, insert at indent "said weak".

Signed and Sealed this

Fifteenth Day of August, 2000

*Attest:*

Q. TODD DICKINSON

*Attesting Officer*

*Director of Patents and Trademarks*